United States Patent [19]

Cummins

[11] Patent Number: 4,486,113

[45] Date of Patent: Dec. 4, 1984

[54] CLAW BINDER

[75] Inventor: Richard D. Cummins, Orchard Park, N.Y.

[73] Assignee: R. D. Cummins, Incorporated, Buffalo, N.Y.

[21] Appl. No.: 428,266

[22] Filed: Sep. 29, 1982

[51] Int. Cl.[3] ..... B42F 3/04; B42F 13/16; B42F 13/00; B42F 13/12

[52] U.S. Cl. ..... 402/80 P; 402/27; 402/70

[58] Field of Search ..... 402/27, 47, 48, 49, 402/53, 54, 55, 56, 70 R, 70, 80 P, 80 R

[56] References Cited

U.S. PATENT DOCUMENTS

| | | | |
|---|---|---|---|
| 918,112 | 4/1909 | Yawman | 402/27 |
| 1,094,019 | 4/1914 | Reifel et al. | 402/28 |
| 2,093,041 | 9/1937 | Emery | 129/1 |
| 2,212,380 | 9/1940 | Steele | 129/9 |
| 2,474,698 | 6/1949 | Segal | 402/70 |
| 2,708,934 | 5/1955 | Pate | 402/27 |
| 3,104,667 | 9/1963 | Mintz | 129/11 |
| 3,220,078 | 11/1965 | Preziosi | 402/80 P |
| 3,529,900 | 9/1970 | Pettit | 402/27 |
| 3,762,823 | 10/1973 | Gregson | 402/70 |
| 3,833,308 | 9/1974 | Seaborn | 402/56 |
| 3,927,949 | 12/1975 | Clinch | 402/70 |

FOREIGN PATENT DOCUMENTS

| | | | |
|---|---|---|---|
| 680227 | 2/1964 | Canada | 402/27 |

*Primary Examiner*—Robert L. Spruill
*Assistant Examiner*—Paul M. Heyrana, Sr.
*Attorney, Agent, or Firm*—Bean, Kauffman & Bean

[57] ABSTRACT

A claw binder features the provision of groups of pairs of claw halves, which vary in size and are adapted to be removably/interchangeably fixed to a base of the binder in order to selectively accommodate the binder to support stacks of sheet material of substantially different thicknesses.

13 Claims, 15 Drawing Figures

Fig. 1.
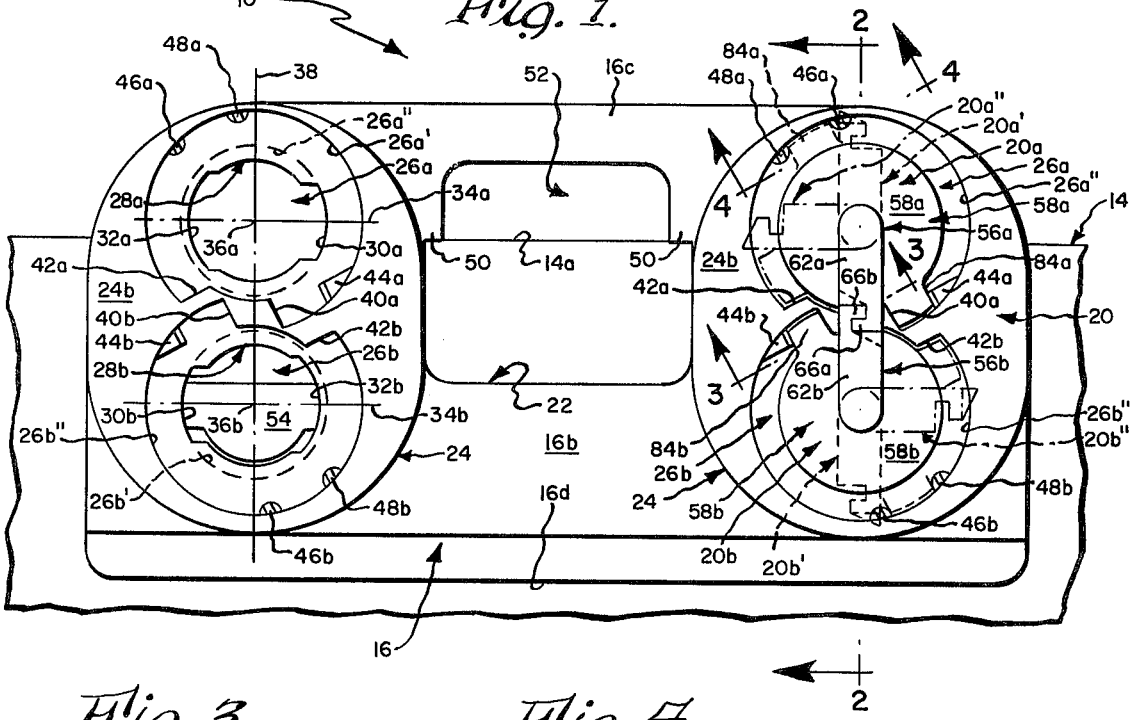
Fig. 3.
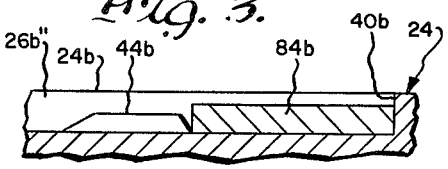
Fig. 4.
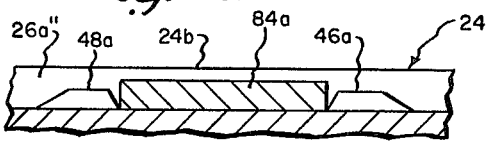
Fig. 5.
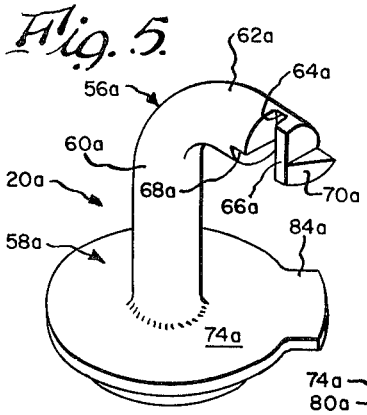
Fig. 6.
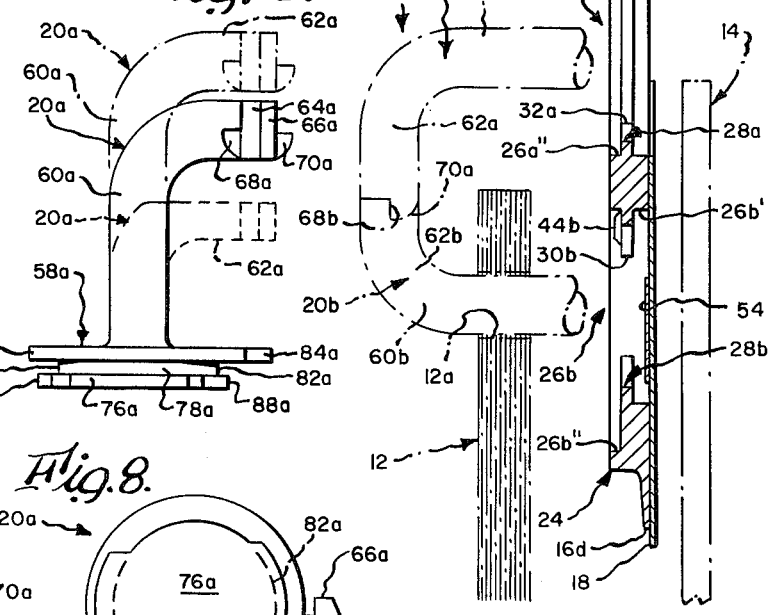
Fig. 7.
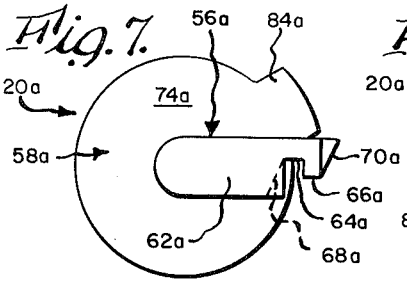
Fig. 8.
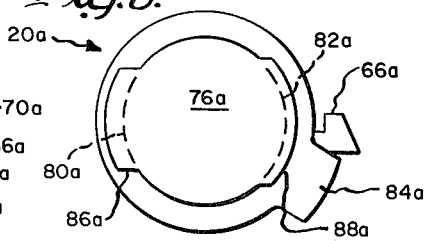
Fig. 2.

Fig. 9.
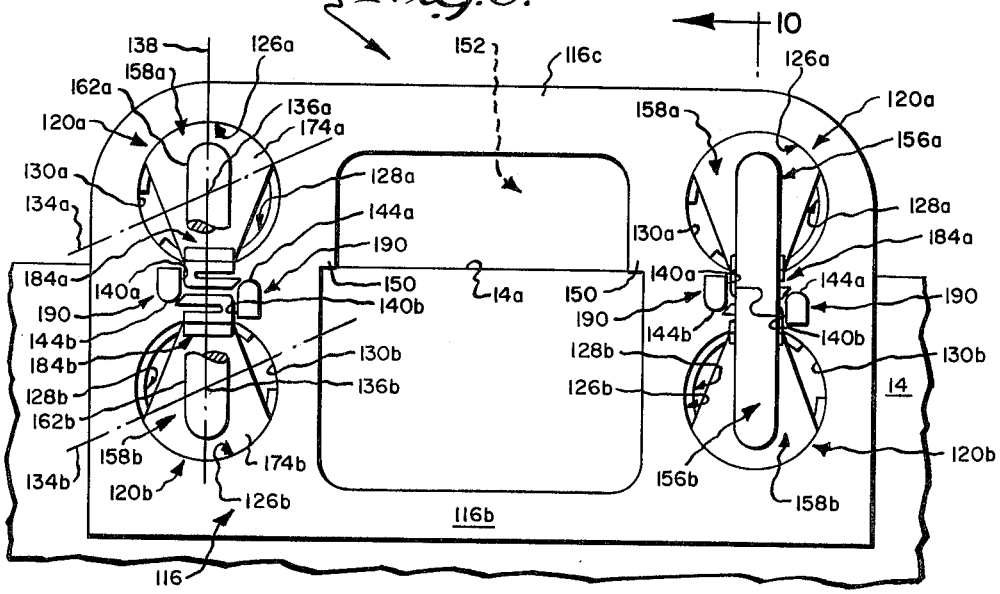
Fig. 13.
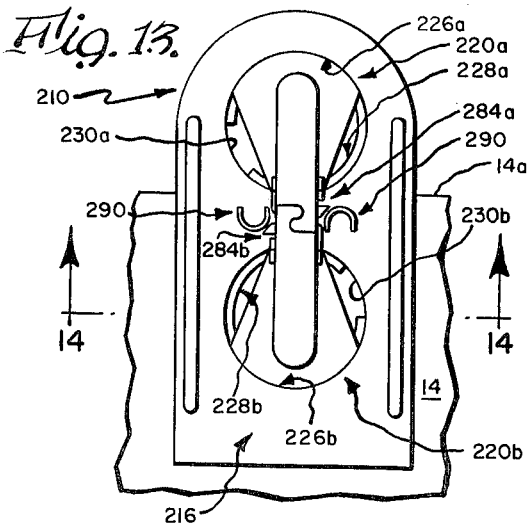
Fig. 11.
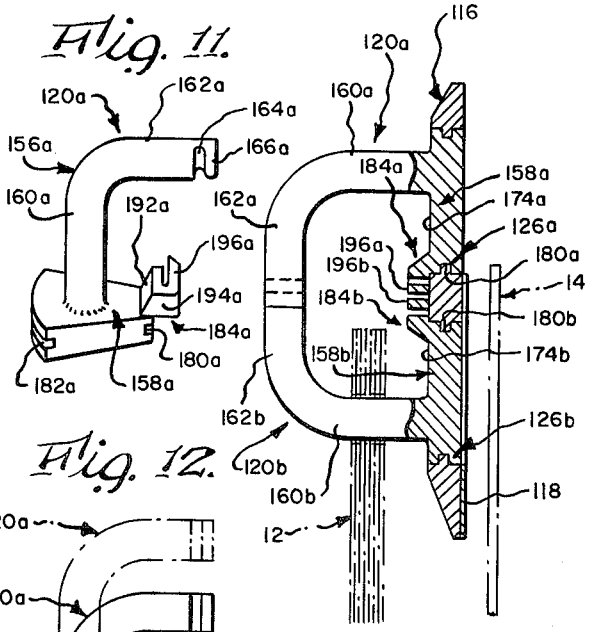
Fig. 12.
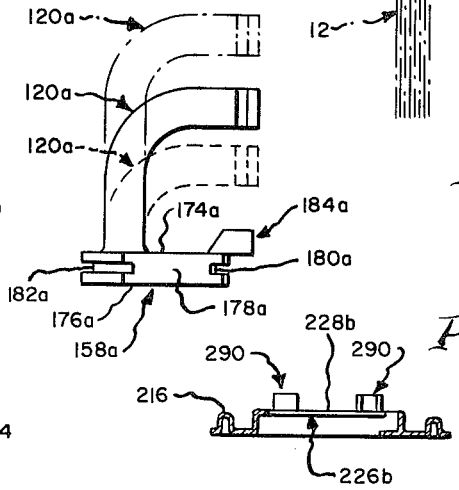
Fig. 10.
Fig. 14.
Fig. 15.
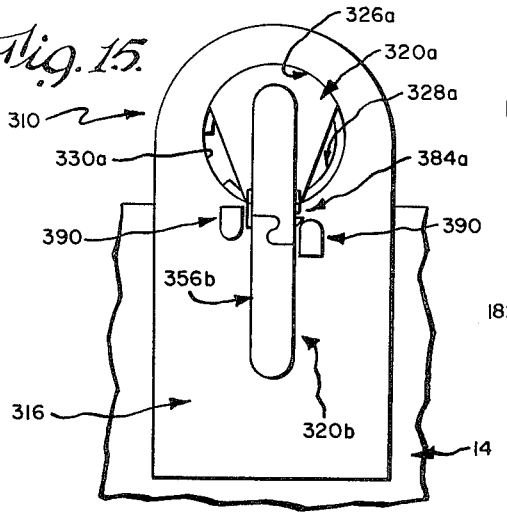

CLAW BINDER

BACKGROUND OF THE INVENTION

The present invention relates to claw or ring binders of the type commonly used to store flexible sheet material, such as paper, having mounting openings for removably/slidably receiving the binder claws. More particularly, the present invention relates to improvements in claw binders of the type described, wherein means are provided to selectively vary the capacity of the binder, so as to accommodate same to store stacks of sheets of differing thickness, while permitting the overall thickness of the binder to be maintained at a minimum for any given stack thickness.

A prior attempt to selectively vary the capacity of a claw binder is disclosed in U.S. Pat. No. 2,093,041, wherein the claw halves or rings are defined by two or more removably interconnected segments, which may be added or removed, as desired, to change the sheet storage capacity of the binder together with its overall thickness. A somewhat similar binder construction is also disclosed in U.S. Pat. No. 3,762,823.

SUMMARY OF THE INVENTION

The preferred form of the present invention is directed towards a claw binder of simple and relatively inexpensive construction characterized in that its sheet storage capacity together with its overall thickness may be selectively varied by a user. More specifically, the presently preferred form of the present binder includes groups of pairs of claw halves, which vary in size and are adapted to be removably/interchangeably fixed to a base of the binder in order to selectively vary the sheet storage capacity thereof; the claw halves being supported on the base for manually induced rotations between closed, open and removal/attachment positions.

In the preferred binder construction, the claw halves and base are formed of molded plastic material, and two pairs of claw halves are removably/rotatably supported on a common base. However, alternative constructions are contemplated wherein the base may be fabricated by stamp forming thin gauge sheet metal and only a single pair of claw halves are removably/rotatably mounted on each base. A still further alternative construction is also disclosed, wherein only one claw half of each pair is removably supported on a base; its associated claw half being mold formed integrally with such base.

DRAWINGS

The nature and mode of operation of the present invention will now be more clearly described in the following detailed description taken with the accompanying drawings wherein:

FIG. 1 is a top plan view of a preferred form of the present binder construction mounted adjacent an upper edge of a suitable support with the left hand pair of claw halves being removed for purpose of clarity;

FIG. 2 is a sectional view taken generally along the line 2—2 in FIG. 1 prior to the attachment of the binder to the support, but with the claw halves together with a stack of paper sheets being shown in broken line;

FIG. 3 is a sectional view taken generally along the line 3—3 in FIG. 1;

FIG. 4 is a sectional view taken generally along the line 4—4 in FIG. 1;

FIG. 5 is a perspective view of a claw half;

FIG. 6 is an elevational view of the claw half shown in FIG. 5 with superimposed broken line showings of differently sized claw halves adapted to be interchangeably mounted on the base of the binder;

FIG. 7 is a top plan view of the claw half shown in FIG. 5;

FIG. 8 is a bottom plan view of the claw half shown in FIG. 5;

FIG. 9 is a top plan view of an alternative form of the present binder construction;

FIG. 10 is a sectional view taken generally along the line 10—10 in FIG. 9 prior to the attachment of the binder to the support with the support together with a stack of paper sheets being shown in broken line;

FIG. 11 is a perspective view of one of the claw halves shown in FIG. 9;

FIG. 12 is an elevational view of the claw half shown in FIG. 11 with superimposed broken line showings of differently sized claw halves adapted to be interchangeably mounted on the base of the binder;

FIG. 13 is a top plan view of a further alternative binder construction, wherein the base is of stamped sheet metal construction and adapted to mount a single pair of claw halves;

FIG. 14 is a sectional view taken generally along the line 14—14 in FIG. 13, but with the claw halves removed; and FIG. 15 is a view similar to FIG. 13, but showing a still further alternative form of the present invention, where only one claw half of each pair is adapted for rotation relative to its associated base.

DETAILED DESCRIPTION

A claw binder constructed in accordance with the preferred form of the present invention is generally designated as 10 in FIGS. 1 and 2 and intended for use in removably supporting a stack of individual sheets of paper or the like 12, shown only in broken line in FIG. 2, on a suitable support 14. Support 14 may, as desired, be in the form of a single rigid piece of sheet material, such as is commonly employed in forming clip boards, or comprise one of a pair of hingedly joined covers formed from either rigid or flexible sheet material and cooperating to define a folder.

Binder 10 generally comprises a base 16, which may be suitably fixed to support 14, such as by means of an adhesive backing or coating, not shown, applied to base rear or lower surface **16*a* and normally covered prior to attachment to the base by a peel-off tape 18, shown only in FIG. 2; and two like pairs of claw halves, only one pair of which is shown in FIG. 1 at 20; such pairs of claw halves being removably mounted on the base in the manner to be described and serving to removably support sheets 12 with the aid of mounting openings or perforations 12*a*** formed in such sheets.

Base 16 is preferably in the form of a generally rectangular plate formed of a molded plastic material, which is shaped to define a centrally located opening 22 partially bounded by a pair of end bosses 24 and 24, which upstand from the front or upper surface **16*b* of the base and define means for removably mounting the pairs of claw halves for rotational movement from their closed positions shown in full line in FIG. 1 for the case of a right hand pair of such claw halves 20*a* and 20*b* through an open or sheet insertion/removal position designated at 20*a*′ and 20*b*′ into a claw half mounting-/removal position designated at 20*a*″ and 20*b*″. The means for removably mounting the pairs of claw halves includes pairs of co-directionally extending or parallel mounting recesses 26a and 26b, which are best shown on the left hand side of FIG. 1 from which an associated pair of claw halves are removed and in FIG. 2 as comprising circular recesses 26a' and 26b' whose lower ends open through base lower surface 16b and whose upper ends communicate with arcuately shaped recesses 26a'' and 26b'', which in turn open through the upper surfaces 24b and 24b of their associated bosses 24 and 24. Recesses 26a and 26b are of like configuration in that they include discontinuous circumferentially extending mounting ribs 28a and 28b employed to provide a rotary guide or support for associated ones of claw halves 20a and 20b, respectively. Mounting ribs 28a and 28b are similar in that they have their free ends spaced to define first clearance openings 30a and 30b and have central portions thereof, which are disposed diametrically opposite from the first clearance openings, cut away or radially outwardly recessed to define second clearance openings 32a and 32b. It will be noted however, that clearance openings 30a and 32a face or open in directions opposite to those of clearance openings 30b and 32b. Preferably, as shown in FIG. 1 for the case of the left hand pair of recesses 26a and 26b clearance openings 30a and 32a and clearance openings 30b and 32b are arranged such that they are bisected by parallel planes 34a and 34b, which extend radially of the parallel axes 36a and 36b of their associated recesses 26a' and 26b', respectively, and form alternate interior angles of approximately 90° with respect to a common plane 38** within which such axes lie.

Now referring to FIGS. 1, 3 and 4, it will be noted that bosses 24 and 24 define stop means in the form of surfaces 40a, 42a and 40b and 42b, which in turn serve to define arcuately opposite ends of recesses 26a'' and 26b'', respectively; and that there upstands within recesses 26a'' and 26b'' first stop members or detents 44a and 44b, which cooperate with stop surfaces 40aand 40b to define the closed positions of claw halves 20a and 20b, and pairs of second stop members or detents 46a, 48a and 46b and 48b, which cooperate with each other to define given open positions of claw halves 20a and 20b. Stop surfaces 42a and 42b serve to limit the extent of counter-clockwise directed rotation of the claw halves 20a and 20b from their closed positions and further to define the mounting/removal positions thereof. It will also be understood by referring to FIGS. 1, 3 and 4, that the arcuately opposite surfaces of stop members 44a, 44b, 46a, 46b, 48a and 48b define upwardly convergent cam surfaces, which are mutually inclined relative to the lower planar surfaces bounding arcuate recesses 26a'' and 26b''.

Again referring to FIG. 1, it will be seen that base opening 22 is preferably configured to provide means, such as may be defined by inwardly offset areas or tabs 50 and 50, which facilitate visual location of binder 10 relative to support 14, such that a portion of the opening extends beyond the upper marginal edge 14a of the support and cooperates with an upper edge portion 16c of base 16 to provide a support opening 52 sized to receive the fingers of a user for carrying purposes and/or a hook or peg for storage purposes. When binder 10 is intended to be fixed to support 14 in the manner shown in FIG. 1, the adhesive backing or coating may be applied only to that portion of base lower surface 16a arranged intermediate areas 50 and 50 and the lower marginal edge 16d of base 16.

If desired, the lower ends of circular recesses 26b' and 26b' may be partially blocked by thin or film-like webs 54 and 54, which serve to separate the claw halves from the upper surface of support 14 and/or tend to prevent coating of the lower extremities of the claw halves with adhesive in the event that same is applied to base 16 subsequent to the mounting of the claw halves.

In accordance with the presently preferred construction, individual claw halves 20a and 20b are of identical molded plastic construction. Thus, only claw half 20a shown in FIGS. 1 and 5–8 need be described in detail with like numbers having "b" suffixes being employed in FIG. 1 to designate like parts of claw half 20b. Claw half 20a generally includes a claw element 56a and suitable means, such as a supporting member 58a formed integrally with the claw element for mounting same on base 16. More specifically, claw element 56a is defined by a straight shank portion 60a, which is fixed to upstand from supporting member 58a, and a curved closure end portion 62a, which is joined to an end of the shank portion remotely of its associated supporting member and has a generally L-shaped free end serving to define a slot recess 64a and an interlocking tab 66a, which are shaped to interfit with a like shaped free end of closure end portion 62b formed as part of an associated claw half 20b, as best shown in FIG. 1. When claw half 20a is formed with a shank portion 60a of any substantial length, such as that shown in full line in FIG. 6, it is desirable to provide for interlocking engagement between the free ends of closure end portions 56a and 56b in a direction extending vertically of their associated supporting members 58a and 58b, so as to prevent the occurrence of vertical misalignment between such free ends. This may be accomplished by providing closure end portions 62a and 62b, as shown in the case of closure end portion 62a in FIGS. 5, 6 and 7, with an undercut or further slot recess 68a arranged to communicate with slot recess 64a and a further interlocking tab 70a arranged to project from interlocking tab 66a, which are adapted to cooperate in the manner indicated in broken line in FIGS. 1 and 2.

Supporting member 58a is preferably defined by a pair of parallel upper and lower plate portions 74a and 76a formed integrally with an intermediate or connecting plate portion 78a, wherein such plate portions cooperate to define circumferentially aligned, diametrically opposite and radially outwardly opening relatively long and short guide slots 80a and 82a sized to freely and slidably receive mounting rib 28a. Upper plate portion 74a, which has a circular disc shaped configuration of a diameter essentially equal to but preferably slightly greater than the diameter of recess 26a', is fitted with a coplanar radially outwardly extending locating or latching tab 84a employed to selectively/releasably latch claw half 20a in its closed and given open positions mentioned above. On the other hand, lower plate portion 76a essentially comprises a continuation of circular, disc shaped intermediate portion 78a, except that it includes a pair of radially projecting arcuate tabs 86a and 88a, which have arcuate lengths and radial dimensions corresponding to, but slightly less than, first and second clearance openings 30a and 32a, respectively.

In a page top binder of the type illustrated, a stack of sheets 12 normally rests on support 14, such that they are supported by claw half shank portions 60b with a given lower sheet forming a part of such stack being adapted to be exposed for view by simply sliding the upper sheets of the stack from claw halves 20b onto claw halves 20*a*. When it is desired to add sheets to or remove sheets from the stack, the binder is manually opened by simultaneously rotating claw halves 20*a* or claw halves 20*b* in a counter-clockwise direction from their illustrated closed positions. As for instance in the case of claw halves 20*a*, sufficient manual pressure must first be applied to resiliently deform locating tabs 84*a* incident to camming engagement thereof with their associated first stop members 44*a*; the degree of manual pressure required to effect deformation of the locating tabs and permit opening movement of the claw halves being selectively controlled by choice of plastic material from which the claw halves are fabricated, the thickness of the locating tabs and the height/configuration of the first stop members.

The extent of opening movement of the claw halves is a matter of choice, in that such opening movement need be sufficient only to permit unobstructed addition or removal of sheets from stack 12. However, in the preferred construction, the provision of the pairs of second stop members 46*a* and 48*a* acting in cooperation with locating tabs 84*a* provides convenient means for releasably retaining claw halves 20*a* in some given open position, wherein unintended movement of the claw halves either for return towards their closed positions or for continued opening movement towards their mounting/removal positions is prevented. When it is desired to return the binder to closed position, the user would simply manually rotate the claw halves in a clockwise sense, as viewed in FIG. 1, while applying sufficient force to first snap the locating tabs 84*a* over second stop members 46*a* and then over first stop members 44*a*.

It will be understood that the claw halves may be initially installed on base 16 or subsequently removed therefrom, when the claw halves are arranged in their mounting/removal positions designated as 20*a*" and 20*b*" in FIG. 1. With specific reference to claw halves 20*a*, it will be understood that when same are in their mounting/removal positions, locating tabs 84*a* are arranged in immediate proximity to their associated stop surfaces 42*a* and arcuate tabs 862 and 88*a* are arranged in alignment with their associated clearance openings 30*a* and 32*a*, respectively, whereby to permit insertion/-removal of each supporting member 58*a* axially of its associated mounting recess 26*a*.

An important feature of the preferred form of the present invention is to provide binder 10 with two or more groups of pairs of claw halves, wherein the groups vary one from another, as shown by way of example in FIG. 6 for the case of claw halves 20*a* of three of such groups, essentially only in the lengths of their respective shank portions in order to selectively accommodate the binder to store stacks of sheets of substantially different thicknesses, while permitting the overall thickness of the binder, as measured normal to base 16, to be kept at a minimum for any given thickness. More specifically, the different groups of claw halves would be selectively interchangeably mounted on base 16 by means of the above described constructions of mounting recesses and their supporting members, which do not vary in shape or size between groups. As further indicated in FIG. 6 in the case of claw half 20*a*, the claw halves included in the smallest or shortest of such groups need not, if desired, be provided with a further slot recess 68*a* and a further interlocking tab 70*a*, since vertical deflection of the free end of its associated closure end portion 62*a*, due to the resiliently deformable nature of the plastic material from which the claw halves are formed, will be essentially negligible.

FIGS. 9–12 illustrate a binder 110 of an alternative construction, wherein parts thereof similar to those described with reference to binder 10 are designated by like one hundred series numerals. More specifically, binder 110 includes a base 116, which is adapted to be suitably affixed to support 14 as by adhesive backing protected prior to attachment by a peel-off tape 118; and two like pairs of claw halves 120*a* and 120*b*, which are removably/rotatably mounted on base 116 by mounting means including two pairs of co-directionally extending or parallel mounting recesses 126*a* and 126*b*. Recesses 126*a* and 126*b* are of like configuration in that they include discontinuous circumferentially extending mounting ribs 128*a* and 128*b* employed to provide a rotary guide or support for associated ones of claw halves 120*a* and 120*b*, respectively. Mounting ribs 128*a* and 128*b* are in turn similar in that they have their free ends spaced to define clearance openings 130*a* and 130*b*. However, as in the case of the first clearance openings of previously described binder 10, clearance openings 130*a* and 130*b* face in opposite directions and are arranged such that they are bisected by parallel planes 134*a* and 134*b*, which extend radially of parallel axes 136*a* and 136*b* of their associated mounting recesses and form alternate interior angles of approximately 60° with a common plane 138 within which such axes lie.

Further, as in the case of the base of binder 10, base 116 is provided with suitable means, which serve to define the closed positions of claw halves 120*a* and 120*b*. However, in accordance with this form of the invention, such means are defined by pairs of stop members 190 and 190, which are formed integrally with base 116 and arranged to extend parallel to and on opposite sides of common plane 138. Stop members 190 and 190 have facing surfaces 140*a* and 140*b*, which are functional equivalents of stop surfaces 40*a* and 40*b*, and rounded cam or latch surfaces 144*a* and 144*b*, which are functional equivalents of first stop members 44*a* and 44*b* in that surfaces 140*a* and 140*b* cooperate with surfaces 144*a* and 144*b* to engage with claw halves 120*a* and 120*b*, respectively, to define the closed positions of the latter. If desired, additional stop members, not shown, may be formed integrally with base 116 for the purpose of defining given open positions of the claw halves 120*a* and 120*b*.

In that the individual claw halves 120*a* and 120*b* are preferably of identical molded plastic construction, only claw half 120*a* need be described in detail with like numerals having "b" suffixes being employed in the drawings to designate like parts of claw half 120*b*. More specifically, claw half 120*a* is shown in FIGS. 9–12 as including a claw element 156*a* and suitable means, such as supporting member 158*a* formed integrally therewith for mounting the claw element on base 116. Claw element 156*a* is defined by a straight shank portion 160*a*, which is fixed to upstand from supporting member 158*a*, and a curved closure end portion 62*a*, which is joined to an end of the shank portion remotely of its associated supporting member and has a generally L-shaped free end serving to define a slot recess 164*a* and an interlocking tab 166*a*, which are shaped to interfit with a like shaped free end of closure end portion 62*b* formed as part of an associated claw half 120*b*, as best shown in FIG. 9.

Supporting member 158*a* is defined by like shaped parallel upper and lower plate portions 174*a* and 176*a* formed integrally with an intermediate or connecting plate portion 178, wherein such plate portions cooperate to define circumferentially aligned, diametrically opposite and radially outwardly opening relatively long and short guide slots 180*a* and 182*a* sized to freely and slidably receive mounting rib 128*a*. As will be apparent from viewing FIG. 9, the arcuate length of short guide slot 180*a*, and thus the arcuate length of bounding edge portions of upper and lower plate portions 174*a* and 176*a*, are less than the arcuate length of clearance opening 130*a*.

It will also be noted by referring to FIGS. 9–12 that in this form of the invention, shank portion 160*a* is disposed in a parallel, offset relationship to the center or rotational axis of its supporting member 158*a*. The offsetting of shank portions 160*a* and 160*b* in this manner provides for a greater spacing therebetween in order to facilitate threading/unthreading of sheets 12 onto the claw halves when same are moved into an open position.

As best shown in FIGS. 9 and 10, upper plate portions 174*a* and 174*b* are provided with locating or latching tabs 184*a* and 184*b*, which cooperate with above described stop members 190 and 190 to selectively/-releasably latch claw halves 120*a* and 120*b* in their closed positions. More specifically, locating tabs 184*a* and 184*b* are of identical construction, and as best shown in the case of locating tab 184*a* in FIG. 11, have a generally U-shaped plan view configuration, including a mounting leg portion 192*a* formed integrally with supporting member 158*a*, a connecting or stop portion 194*a* and a latching leg portion 196*a* having a beveled free end. When claw half 120*a* is in its closed position, connecting portion 194*a* is arranged to engage with surface 140*a* in order to positively prevent clockwise directed rotational movement of the claw half; and the beveled free end of latching leg portion 196*a* is arranged to engage with cam or latching surface 144*a* in order to provide a releasable, resiliently deformable latch device tending to normally prevent counter-clockwise directed or opening rotational movement of the claw half.

When it is desired to add sheets to or remove sheets from binder 110, the binder is manually opened by simultaneously rotating claw halves 120*a*, 120*a* or claw halves 120*b*, 120*b* in a counter-clockwise direction from their illustrated closed positions with sufficient manual pressure first being applied to resiliently deform latching leg portions 196*a* or 196*b*, as an incident to camming engagement of their beveled ends with cam or latch surfaces 144*a* or 144*b*. The degree of manual pressure required to effect deformation of the latching leg portions may be selectively controlled by the choice of plastic material from which the claw halves are fabricated and/or the thickness of the connecting and latching leg portions of the locating tabs. When it is desired to return the binder to closed position, the user would simply rotate the claw halves in a clockwise sense, as viewed in FIG. 9, while employing sufficient force to snap the locating tabs over their associated stop members 190 and 190.

By reference to FIG. 12, it will be understood that binder 110 preferably incorporates the feature discussed with reference to binder 10, wherein two or more groups of pairs of claw halves may be provided for the purpose of selectively accommodating the binder to store stacks of sheets of substantially different thickness, while permitting the overall thickness of the binder, as measured normal to base 116, to be kept to a minimum for any given stack thickness. When it is desired to remove claw halves for purposes of replacement, it is necessary to merely rotate same in a counter-clockwise direction from their closed positions past a normal range of their open positions, wherein sheets may conveniently be added or removed therefrom, until their short guide slots 180*a* and 180*b* are brought into alignment with clearance openings 130*a* and 130*b*. When so positioned, a vertical lifting force applied for instance to locating tabs 184*a* and 184*b* will act to resiliently deform supporting members 158*a* and 158*b* by a slight amount allowing same to be withdrawn from within their associated mounting recesses 126*a* and 126*b*.

FIGS. 13 and 14 illustrate a binder 210 of a further alternative construction, wherein parts thereof similar to binders 10 and 110 are designated by like two hundred series numerals. Binder 210 differs from binders 10 and 110 primarily in that base 216 is formed of stamped sheet metal to define mounting recesses 226*a* and 226*b*, mounting ribs 228*a* and 228*b*, and stop members 290 and 290; and in that base 216 is intended to support only a single pair of molded plastic claw halves 220*a* and 220*b*. Binder 210 has the advantage that it can be used alone or in association with like binders to support sheets having other than a pair of mounting openings or mounting openings having non-standard spacing therebetween. Further, as in the case of the previously described embodiments of the present binder, claw halves 220*a* and 220*b* may be provided in different sizes, so as to accommodate binder 210 for storage of stacks of sheets of varying thickness.

FIG. 15 illustrates a binder 310 of a still further alternative construction, wherein parts thereof similar to binders 10, 110 and 210 are designated by like three hundred series numerals. Binder 310 may include only the illustrated single pair of claw halves 320*a* and 320*b*, as in the case of binder 210, or if desired, pairs of claw halves, as in the case of binders 10 and 110. However, binder 310 differs from the binders previously described in that one of the claw halves of each pair, such as claw half 320*b*, has its claw element 356*b* formed as an integral or non-movable part of base 316 and only claw half 320*a* is removably supported in order to permit initial mounting and subsequent opening/closing movement thereof. If desired, claw half 320*a* may be identical in construction to claw halves 120*a* and 220*a*. While binder 310 has the advantage of simplicity of construction and a minimum number of parts, it nonetheless suffers from the disadvantage that it may not be adjusted to increase or decrease its claw length in accordance with the thickness of a stack of sheets to be stored.

What is claimed is:

1. In a claw binder construction having a base to be fixed to a support and two pairs of claw halves mounted on said base for relative movement between a closed position, wherein said claw halves cooperate for supporting a stack of sheets on said support, and an open position, wherein said claw halves are moved relatively apart to permit addition/removal of said sheets, the improvement comprising in combination:

each claw half of each said pair of claw halves is mounted on said base for rotational movement about an axis disposed normal to said base from said closed position and through said open position into a mounting/removal position in which said claw half may be removably mounted on said base, said base is formed with one pair of parallel mounting recesses for mounting each said pair of claw halves, each of said claw halves includes a supporting member removably and rotatably mounted within one of said mounting recesses and a claw element having a shank portion fixed to upstand from said supporting member and a closure end portion joined to said shank portion remotely of said supporting member, said claw halves of each pair having free ends of their closure end portions shaped to interfit one with the other when said pair of claw halves are in said closed position, the first said pairs of claw halves forming one group of pairs of claw halves characterized as having shank portions of a given length, and there is further provided in combination at least one additional group of pairs of claw halves interchangeably mounted with the claw halves of said one group and characterized as having shank portions of a length other than said given length, said mounting recesses each include a discontinuous circumferentially extending mounting rib whose free ends are spaced to define a first clearance opening, each said supporting member is formed with circumferentially aligned, diametrically opposite and radially outwardly opening guide slots sized to freely and slidably receive said mounting rib of one of said mounting recesses for mounting said supporting member therewithin, and one of said guide slots having an arcuate length less than that of said first clearance opening is aligned therewith upon movement of its associated one of said claw halves into said mounting/removal position to permit removable mounting thereof on said base.

2. The improvement according to claim 1, wherein the shank portions of each pair of claw halves are disposed in a parallel offset relationship relative to said axes.

3. The improvement according to claim 1, wherein said base is of plate-like configuration and has a centrally located through opening arranged intermediate upper and lower edges thereof, means to visually align said base with an edge of said support to position said upper edge and at least a part of said through opening outwardly of said support beyond said edge thereof and two pairs of said mounting recesses are disposed on opposite sides of said through opening intermediate same and opposite end edges of said base joining said upper and lower edges, and a pair of said claw halves is removably mounted one pair in each said pair of mounting recesses.

4. In a claw binder construction having a base to be fixed to a support and two pairs of claw halves mounted on said base for relative movement between a closed position, wherein said claw halves cooperate for supporting a stack of sheets on said support, and an open position, wherein said claw halves are moved relatively apart to permit addition/removal of said sheets, the improvement comprising:

at least one claw half of each pair of claw halves is mounted on said base for rotational movement about an axis disposed normal to said base from said closed position and through said open position into a mounting/removal position in which said one claw half may be removably mounted on said base, said base is formed with a mounting recess for receiving each said one claw half, each said mounting recess has a discontinuous circumferentially extending mounting rib whose free ends are spaced to define a first clearance opening, each said one claw half includes a supporting member formed with circumferentially aligned, diametrically opposite and radially outwardly opening, guide slots sized to freely and slidably receive said mounting rib of said mounting recess in which same is received for permitting rotational movement of said one claw half between said closed position and said mounting/removal position, one of said guide slots has an arcuate length less than that of said fist clearance opening, and said one of said guide slots is aligned with said first clearance opening upon movement of said one claw half into said mounting removal position to permit removable mounting thereof on said base.

5. The improvement according to claim 4, wherein means on said base cooperates with means on each said one claw half for releasably retaining same in said closed position.

6. The improvement according to claim 5, wherein additional means on said base cooperates with said means on each said one claw half for defining an open position thereof intermediate said closed and mounting-/removal positions and releasably retaining same from movement beyond said open position towards said mounting/removal position.

7. The improvement according to claim 6, wherein both claw halves of each said pair are removably mounted on said base.

8. The improvement according to claim 5, wherein said means on said base includes a stop and a detent spaced circumferentially of said mounting recess from said stop, and said means on each said claw half is a resiliently deformable tab on said supporting member arranged to engage said stop to define said closed position and to move over said detent upon movement of each said one claw half from said closed position towards said open position.

9. The improvement according to claim 8, wherein additional means on said base cooperates with said tab on each said one claw half for defining said open position and releasably retaining same from movement beyond said open position towards said mounting/removal position, said additional means on said base includes a pair of detents spaced circumferentially of said mounting recess from said detent and spaced one from another to receive said tab therebetween.

10. In a claw binder construction having a base to be fixed to a support and at least one pair of claw halves mounted on said base for relative movement between a closed position, wherein said claw halves cooperate for supporting a stack of sheets on said support, and an open position, wherein said claw halves are moved relatively apart to permit addition/removal of said sheets, the improvement comprising in combination:

said base having at least one mounting recess, each claw half of said pair of claw halves having a shank portion mounted on said base and a closure end portion integrally joined to said shank portion remotely of said base, at least one claw half of each said pair of claw halves being of integrally formed molded plastic construction and including a supporting member joined to said shank portion remotely of said closure end portion thereof and removably received within said recess, said supporting member and said recess having means cooperating to support said one claw half for rotational movement about an axis disposed normal to said base from said closed position and through said open position into a mounting/removal position in which said one claw half may be removed from within said recess, said supporting member having a resiliently deformable locating tab, said base having a stop arranged for engagement with said tab to define said closed position and a first detent spaced from said stop in the direction of rotation of said one claw half towards said mounting/removal position and cooperating with said stop and said locating tab to releasably retain said one claw half in said closed position.

11. The improvement according to claim 10, wherein additional means on said base cooperates with said tab for defining said open position and said additional means is defined by a pair of detents spaced one from another to removably receive said tab therebetween.

12. The improvement according to claim 10, wherein said base is formed with at least one pair of mounting recesses and both claw halves of each said pair are provided with an integral supporting member removably and rotatably mounted one within each of said mounting recesses, the first said pair of claw halves forming one group of pairs of integrally formed claw halves characterized as having shank portions of a given length, and there is further provided in combination at least one additional group of pairs of integrally formed claw halves interchangeably mounted with said one group in said mounting recesses and characterized as differing from said one group in that the shank portions thereof are of a length other than said given length.

13. The improvement according to claim 10, wherein said base is formed with at least one pair of mounting recesses and said supporting member is provided one on each of said claw halves of each pair for removably mounting same within said recesses for rotational movements about parallel axes disposed normal to said base, and said shank portions of each said pair of claw halves are disposed in a parallel offset relationship relative to said axes, whereby the distance between said shank portions when said pair of claw halves are in said closed position exceeds the distance between said axes.

* * * * *